US009874081B2

(12) United States Patent
Skinner

(10) Patent No.: US 9,874,081 B2
(45) Date of Patent: Jan. 23, 2018

(54) DETECTION OF INFLUXES AND LOSSES WHILE DRILLING FROM A FLOATING VESSEL

(71) Applicant: Halliburton Energy Services, Inc., Houston, TX (US)

(72) Inventor: Neal G. Skinner, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 337 days.

(21) Appl. No.: 14/421,369

(22) PCT Filed: Oct. 5, 2012

(86) PCT No.: PCT/US2012/059079
§ 371 (c)(1),
(2) Date: Feb. 12, 2015

(87) PCT Pub. No.: WO2014/055090
PCT Pub. Date: Apr. 10, 2014

(65) Prior Publication Data

US 2015/0218931 A1 Aug. 6, 2015

(51) Int. Cl.
*E21B 47/00* (2012.01)
*E21B 44/00* (2006.01)
(Continued)

(52) U.S. Cl.
CPC ..... *E21B 47/0001* (2013.01); *E21B 7/12* (2013.01); *E21B 21/08* (2013.01); *E21B 44/00* (2013.01);
(Continued)

(58) Field of Classification Search
CPC ..... E21B 47/0001
See application file for complete search history.

(56) References Cited

U.S. PATENT DOCUMENTS 3,760,891 A 9/1973 Gadbois
3,910,110 A 10/1975 Jefferies
(Continued)

FOREIGN PATENT DOCUMENTS

CN 101680793 A 3/2010
EA 201000215 A1 10/2010
(Continued)

OTHER PUBLICATIONS

Mohammadrezo Kamyab et al., Early Kick Detection Using Real Time Data Analysis with Dynamic Neural Network: A Case Study in Iranian Oil Fields, Society of Petroleum Engineers, No. SPE 136995, Aug. 7, 2010, XP55272272, retrieved from the Internet: URL: https://www.onepetro.org/download/conference-paper/SPE-136995-MS?id=conference-paper/SPE-136995-MS.
(Continued)

*Primary Examiner* — Robert R Raevis
(74) *Attorney, Agent, or Firm* — Chamberlain Hrdlicka

(57) ABSTRACT

A system for detecting fluid influxes and losses can include a sensor which detects floating vessel movement, and a neural network which receives a sensor output, and which outputs a predicted flow rate from a wellbore. A method can include isolating the wellbore from atmosphere with an annular sealing device which seals against a drill string, inputting to a neural network an output of a sensor which detects vessel movement, the neural network outputting a predicted flow rate from the wellbore, and determining whether the fluid influx or loss has occurred by comparing the predicted flow rate to an actual flow rate from the wellbore. Another method can include inputting to a neural network actual flow rates into and out of the wellbore, and an output of a sensor which detects vessel movement, and training the neural network to output a predicted flow rate from the wellbore.

30 Claims, 4 Drawing Sheets

(51) Int. Cl.

| | |
|---|---|
| ***E21B 7/12*** | (2006.01) |
| ***E21B 21/08*** | (2006.01) |
| ***E21B 49/08*** | (2006.01) |
| *E21B 41/00* | (2006.01) |

(52) U.S. Cl.
CPC ..... *E21B 49/08* (2013.01); *E21B 2041/0028* (2013.01)

(56) References Cited

U.S. PATENT DOCUMENTS

| | | | | |
|---|---|---|---|---|
| 4,282,939 | A | 8/1981 | Maus | |
| 4,440,239 | A | 4/1984 | Evans | |
| 4,527,425 | A | 7/1985 | Stockton | |
| 5,168,932 | A | 12/1992 | Worrall et al. | |
| 5,205,165 | A | 4/1993 | Jardine et al. | |
| 6,278,937 | B1 * | 8/2001 | Ishida | E21B 41/0014 114/264 |
| 2002/0112888 | A1 | 8/2002 | Leuchtenberg | |
| 2003/0079912 | A1 | 5/2003 | Leuchtenberg | |
| 2006/0037781 | A1 | 2/2006 | Leuchtenberg | |
| 2006/0058929 | A1 * | 3/2006 | Fossen | B63B 9/001 701/21 |
| 2006/0113110 | A1 | 6/2006 | Leuchtenberg | |
| 2007/0168056 | A1 * | 7/2007 | Shayegi | G05B 13/048 700/48 |
| 2008/0041149 | A1 | 2/2008 | Leuchtenberg | |
| 2012/0037361 | A1 | 2/2012 | Santos et al. | |

FOREIGN PATENT DOCUMENTS

| | | | |
|---|---|---|---|
| GB | 2106961 | A | 4/1983 |
| JP | 10-311191 | A | 11/1998 |
| WO | 0250398 | A1 | 6/2002 |

OTHER PUBLICATIONS

Supplementary European Search Report in Corresponding Application No. EP 12886057.4, dated May 24, 2016 (8 pages).

International Search Report and Written Opinion issued in corresponding application PCT/US2012/059079, dated Oct. 4, 2014, 3 pgs.

* cited by examiner

DETECTION OF INFLUXES AND LOSSES WHILE DRILLING FROM A FLOATING VESSEL

TECHNICAL FIELD

This disclosure relates generally to equipment utilized and operations performed in conjunction with a subterranean well and, in one example described below, more particularly provides for detection of influxes and losses while drilling from a floating vessel.

BACKGROUND

In certain types of drilling operations from a floating vessel, a riser string volume can change as the vessel rises and falls, due to wave motion or tides. This changing volume can make it difficult to determine whether fluid is entering or leaving an earth formation penetrated by a wellbore being drilled.

Therefore, it will be appreciated that improvements are continually needed in the art of detecting influxes (kicks) and losses while drilling from a floating vessel.

DETAILED DESCRIPTION

Figure 1:
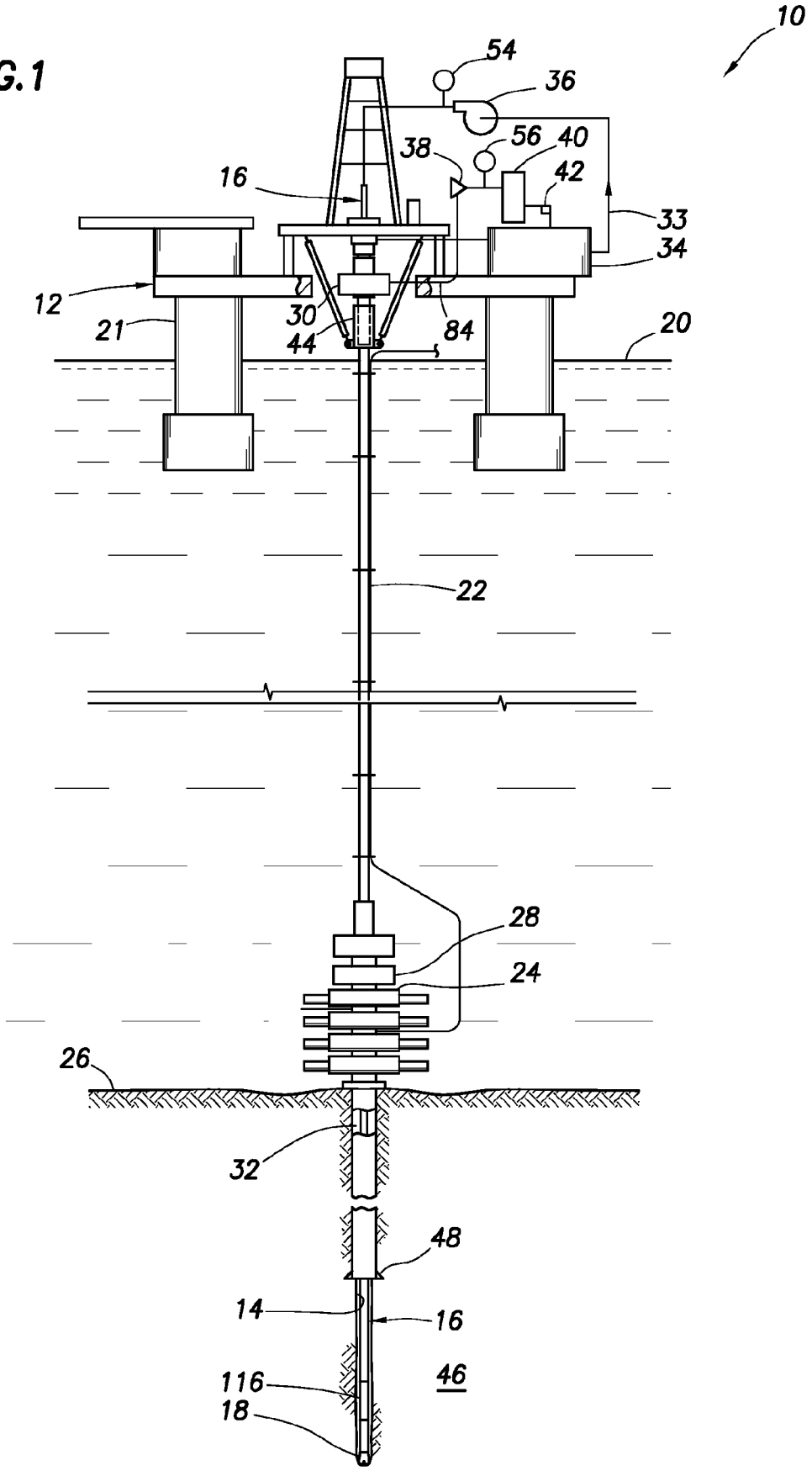
FIG. 1 is a representative partially cross-sectional view of a well system and associated method which can embody principles of this disclosure.

Representatively illustrated in FIG. 1 is a system 10 for drilling a well, and an associated method, which system and method can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the well system 10 depicted in FIG. 1, a floating rig 12 is used to drill a wellbore 14. A generally tubular drill string 16 has a drill bit 18 connected at a lower end thereof, and the drill bit is rotated and/or otherwise operated to drill the wellbore 14.

The drill string 16 could be rotated by the rig 12, the drill string could have a Moineau-type fluid motor (not shown) for rotating the drill bit, and/or the wellbore 14 could be drilled by impacts delivered to the drill bit, etc. The drill string 16 could be continuous or segmented, and the drill string could have wires, optical waveguides, fluid conduits or other types of communication paths associated with the drill string for transmission of data signals, command/control signals, power, flow, etc. Thus, it will be appreciated that the drill string 16 depicted in FIG. 1 is merely one example of a variety of different types of drill strings which could be used in the well system 10.

The rig 12 is depicted in FIG. 1 as comprising a floating vessel 21 positioned at a surface location (e.g., at a surface 20 of a deep or ultra-deep body of water). The vessel 21 rises and falls in response to wave action and tides.

In the FIG. 1 example, a marine riser 22 extends between the rig 12 and a blowout preventer stack 24 positioned at a subsea location (e.g., at a mud line or on a seabed 26). The riser 22 serves as a conduit for guiding the drill string 16 between the rig 12 and the blowout preventer stack 24, for flowing fluids between the rig and the wellbore 14, etc.

Interconnected between the riser 22 and the blowout preventer stack 24 is an annular blowout preventer 28. The annular blowout preventer 28 is designed to seal off an annulus 32 about the drill string 16 in certain situations (e.g., to prevent inadvertent release of fluids from the well in an emergency, etc.), although a typical annular blowout preventer can seal off the top of the blowout preventer stack 24 even if the drill string is not present in the annular blowout preventer.

Near an upper end of the riser 22 is an annular sealing device 30, which is also designed to seal off the annulus 32 about the drill string 16, but the annular sealing device is designed to do so while the drill string is being used to drill the wellbore 14. If the drill string 16 rotates while drilling the wellbore 14, the annular sealing device 32 is designed to seal about the rotating drill string.

The annular sealing device 30 may be of the type known to those skilled in the art as a rotating blowout preventer, a rotating head, a rotating diverter, a rotating control device (RCD), a drilling head, etc. The annular sealing device 32 may be passive or active, in that one or more seals thereof may be always, or selectively, extended into sealing engagement with the drill string 16.

The seal(s) of the annular sealing device 32 may or may not rotate with the drill string 16. The seals preferably isolate the annulus 32 in the riser 22 from communication with the earth's atmosphere.

Drilling fluid 33 is contained in a reservoir 34 of the rig 12. A rig pump 36 is used to pump the drilling fluid 33 into the drill string 16 at the surface. The drilling fluid flows through the drill string 16 and into the wellbore 14 (e.g., exiting the drill string at the drill bit 18).

The drilling fluid 33 then flows through the annulus 32 back to the reservoir 34 via a choke manifold 38, a gas buster or "poor boy" degasser 40, a solids separator 42, etc. However, it should be understood that other types and combinations of drilling fluid handling, conditioning and processing equipment may be used within the scope of this disclosure.

A pressure control system (not shown) can be used to control pressure in the wellbore 14. The pressure control system can operate the choke manifold 38, so that a desired amount of backpressure is applied to the annulus 32. The pressure control system may regulate operation of other equipment (e.g., the pump 36, a standpipe control valve, a diverter which diverts flow from the pump 36 to a drilling fluid return line 84 upstream of the choke manifold 38, etc.), as well.

In different situations, it may be desired for pressure in the wellbore 14 to be less than, greater than or equal to pore pressure in an earth formation 46 penetrated by the wellbore. Typically, it is desired for the wellbore pressure to be less than a fracture pressure of the formation 46.

Persons skilled in the art use terms such as underbalanced drilling, managed pressure drilling, at balance drilling, conventional overbalanced drilling, etc., to describe how wellbore pressure is controlled during the drilling of a wellbore. The pressure control system can be used to control wellbore pressure in any type of drilling operation, and with any desired relationship between wellbore pressure and formation 46 pore and/or fracture pressure.

The pressure control system can be used to control pressure over time at any location along the wellbore 14, and for any purpose. For example, it may be desired to precisely control pressure at a bottom end of the wellbore 14, or at a particular location relative to the formation 46, or at a pressure sensitive area (such as, at a casing shoe 48), etc. Control over the wellbore pressure may be for purposes of avoiding fractures of the formation 46, avoiding loss of drilling fluid 33, preventing undesired influx of formation fluid into the wellbore 14, preventing damage to the formation, etc.

During managed pressure drilling (MPD) operations, the pressure (hydrostatic pressure plus fluid friction pressure) in the wellbore 14 at the drill bit 18 and along an open hole section is carefully controlled to remain slightly above formation 46 pressure. If the wellbore 14 pressure drops below formation 46 pressure this may result in a "kick" or undesired influx of formation fluids entering the wellbore. Alternatively, if the wellbore 14 pressure becomes significantly greater than the formation 46 pressure, drilling fluid 33 may leave the annulus 32 and be lost into the formation.

Both kicks and losses are undesirable drilling events which require proper corrective actions by a drilling operator before MPD can be safely resumed. It is easier to counteract kicks and losses if they are discovered quickly. These problems tend to get worse over time, and a minor event may turn into a major one if a kick or loss is not detected quickly.

Losses and kicks are relatively easy to detect when performing MPD with conventional land rigs. One simply measures the amount of drilling fluid entering and leaving the wellbore. In conventional drilling, these flows should normally be equal. When what goes in equals what goes out, no kicks or losses are present. Kicks are indicated when the volume of fluid leaving the well exceeds what is pumped in, and conversely, losses are indicated when the volume of fluid pumped into the wellbore exceeds what is returned.

During MPD operations on a floating vessel 21, the detection of kicks and losses is complicated by the fact that during the drilling operations, the returns from the wellbore 14 are not constant, even if the drilling fluid 33 is pumped in at a constant rate. The floating vessel 21 is connected to the marine riser 22 via a telescoping joint 44 (also known as a sliding joint or a slip joint), in order to accommodate vertical motion of the vessel 21 due to wave and tide influence.

As the telescoping joint 44 extends and contracts with wave and tide motion, a volume of the annulus 32 between an outer diameter of the drill string 16 and an inner diameter of the riser 22 changes. Therefore, fluid 33 flow from the annulus 32 changes with the motion of the vessel 21 while drilling, even if the pump rate into the drill string 16 remains constant. Since the volume of the fluid 33 leaving the well is constantly changing, detecting kicks and losses by simply measuring the difference in flow rate between fluid leaving and entering the well becomes problematic.

Fortunately, the relationship between the instantaneous change in volume of the annulus 32 and the vertical velocity of the floating vessel 21 is easily found by:

$$\Delta V(t)=Av(t) \tag{1}$$

where $\Delta V(t)$ is the change in volume leaving the well, A is the differential area of the telescoping joint 44, and v(t) is the vertical velocity of the floating vessel 21.

In Equation (1), the area A is readily computed from a geometry of the telescoping joint 44. In general, there may be two types of joint 44 as representatively illustrated in FIGS. 2A & B.

Figure 2B:
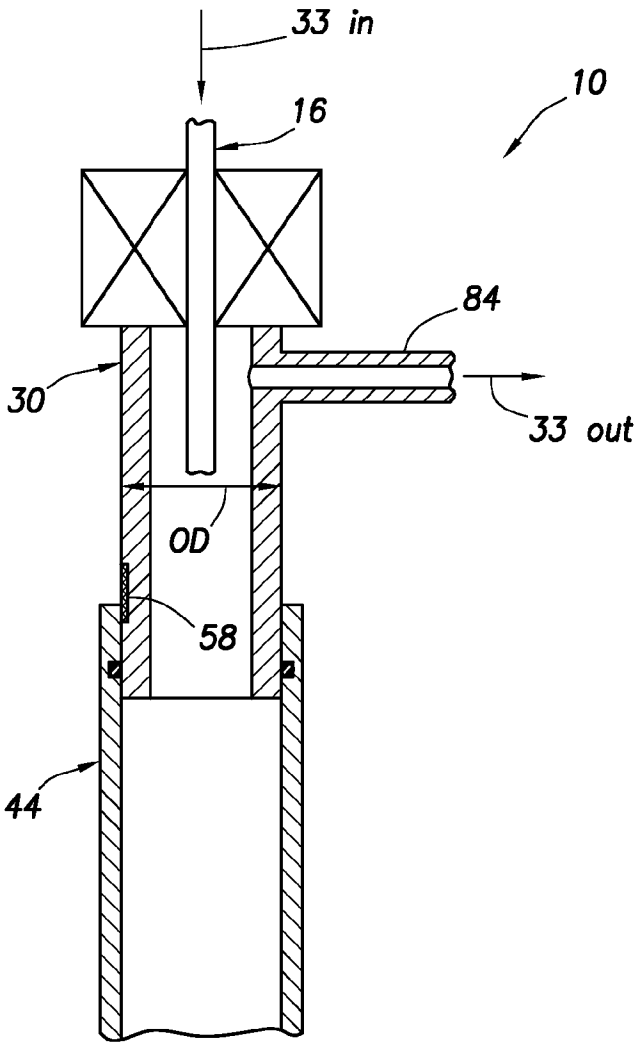
FIGS. 2A & B are representative cross-sectional views of a rotating control device and a sliding joint which may be used in the system and method of FIG. 1.
Figure 2A:
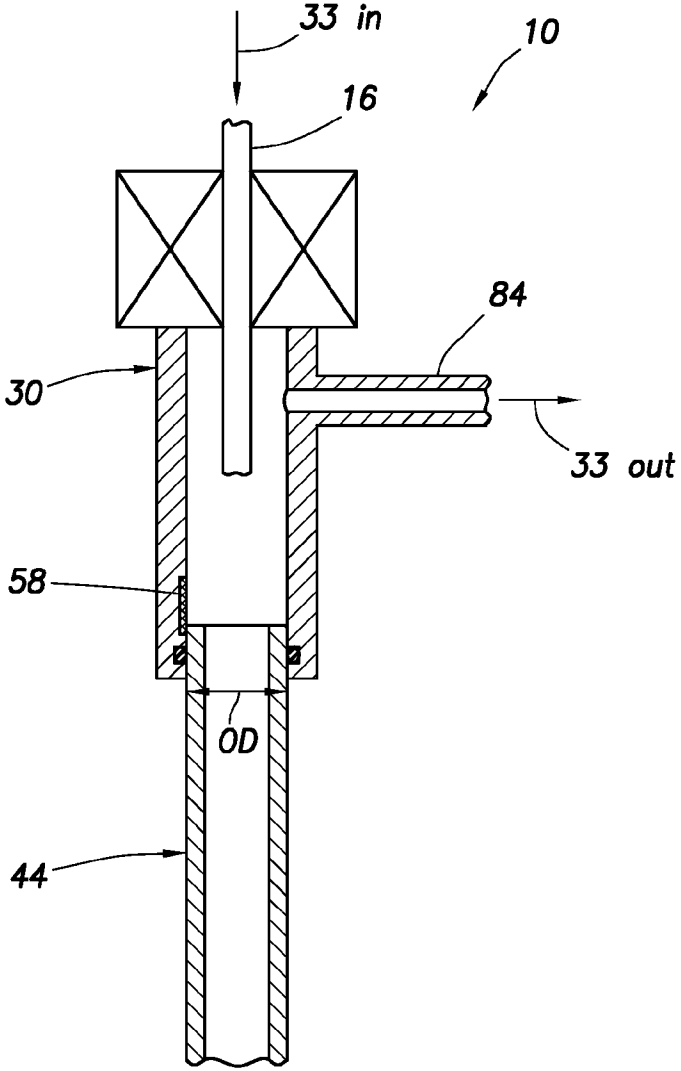

Most telescoping joints 44 are similar to that shown in FIG. 2A. The FIG. 2B telescoping joint 44 is included for generality.

For either of the illustrated telescoping joints 44, the area A is given by:

$$A = \frac{\pi}{4}OD^2. \tag{2}$$

As shown in Equations 1 and 2, given the geometry of the telescoping joint 44 and the vertical velocity of the floating vessel 21, the change in volume per unit time, or change in flow rate associated with vessel movement can be readily found.

Fortunately, virtually all (if not all) floating drilling vessels have some sort of heave or motion compensation system that helps keep the bit 18 on bottom while drilling. By electrically or mechanically tying into this motion compensation system, the vessel's 21 movement can be readily determined.

Knowing the vessel's 21 movement, the change in flow rate of the fluid 33 leaving the well due to motion can be determined. This information can be used to correct the flow rate of the fluid 33 leaving the well, so that kicks and losses can be accurately detected during, for example, MPD or other closed wellbore pressure controlled drilling operations.

However, MPD equipment (e.g., the annular sealing device 30, the choke manifold 38, etc.) is usually only on the vessel 21 for a limited period of time and it may be expensive, difficult or inconvenient to tie into the vessel's motion compensation system. Described below is a method which compensates for changes in flow rate due to vessel 21 movement, and which can readily and inexpensively be incorporated into existing MPD equipment. This can eliminate a requirement of tying into any of the vessel's 21 control systems, although the vessel's motion compensation system may be used, if desired.

Figure 3:
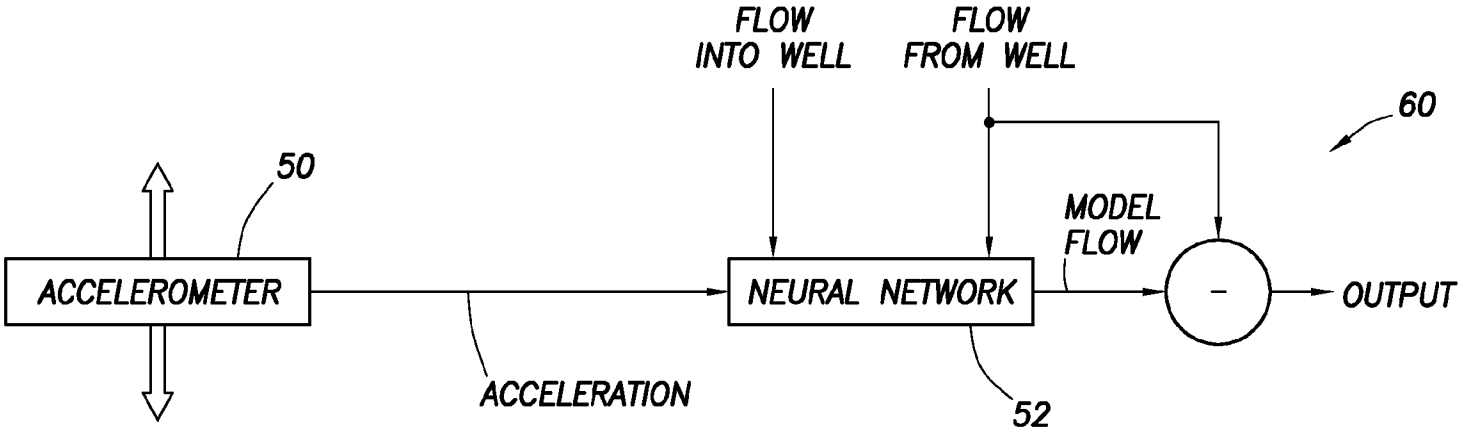
FIGS. 3-5 are representative schematic views of a system and method for detecting influxes and losses, which system and method can embody the principles of this disclosure.

In an example depicted schematically in FIG. 3, an accelerometer 50 is mounted at any location on the vessel 21. However, it should be clearly understood that a system 60 for compensating for vessel movement in closed wellbore pressure controlled drilling described herein is not necessarily used with the well system 10 of FIG. 1. The scope of this disclosure is not limited to use with any particular well system.

An orientation of the accelerometer 50 is preferably chosen, so that an output of the accelerometer is proportional to the vertical acceleration of the vessel 21. The accelerometer 50 could in some examples be mounted in or on the MPD equipment, thereby requiring no additional hookup or installation when rigging up equipment for MPD operations.

As depicted in FIG. 3, the accelerometer 50 output (Acceleration) is input to an adaptive neural network filter 52, along with measurements of flow rate into the well and flow rate from the well. The flow rates could be obtained, for example, by use of flowmeters 54, 56 in the FIG. 1 system.

An adaptive neural network filter as used herein indicates a neural network made up of interconnected neurons (or processing units) which change structure during a learning or training stage. The neural network can be used to model complex relationships between input and output data.

An objective function of the neural network 52 in the FIG. 3 example is to predict the flow rate from the well (Model Flow) given inputs from the accelerometer 50, flow rate into the well and flow rate from the well. After a relatively short time period to dynamically train the neural network 52, the output of the network should very closely approximate the time dependent flow out of the well.

As further depicted in FIG. 3, the modeled flow from the neural network 52 is subtracted from the measured flow from the well. If no kicks or losses are present, this difference should be approximately zero, with some expected small error in the measured flow from the well and the output of the neural network 52.

A kick is indicated when the difference (measured flow rate minus modeled flow rate) is positive, and a loss is indicated when this difference is negative. Some experience and experimentation with the system 60 in simulated and real world applications will be useful in order to determine how much flow rate difference is significant.

Note that in Equation 1, the difference in flow rate due to vessel 21 movement depends on the velocity of the vessel, and not its acceleration. The structure and complexity of the neural network 52 (e.g., a number of layers in the network, a number of neurons in each layer and activation functions connecting the neurons) should be able to automatically compute the integral from acceleration to velocity.

Note also, in the FIG. 3 example, that inputs to the neural network 52 do not include any geometrical details (OD, ID, etc.) related to the telescoping joint 44. These values may either be pre-programmed into the neural network 52 or the complexity of the neural network may be sufficient that it does not require this information in order to make accurate predictions of flow rate leaving the well.

Figure 4:
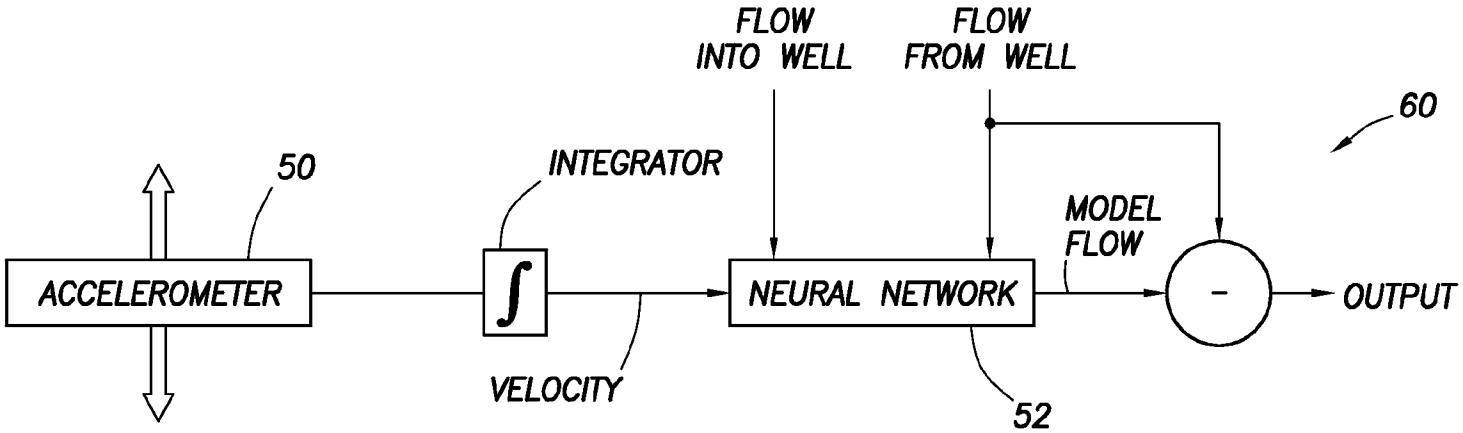

FIG. 4 illustrates a modified system 60 for detecting kicks and losses during closed wellbore controlled pressure drilling operations on floating vessels, in which an integrator is added between the accelerometer 50 and the neural network 52. By integrating the acceleration signal, a signal proportional to the velocity of the vessel 21 is input to the neural network 52.

Since the integration required to convert a signal proportional to acceleration to a signal proportional to velocity is performed outside of the neural network 52, the neural network shown in FIG. 4 may be simpler than that required for the system 60 shown in FIG. 3. With the exception that the effective integration is performed outside of the neural network 52, the systems 60 depicted in FIGS. 3 & 4 are physically and functionally similar.

Figure 5:
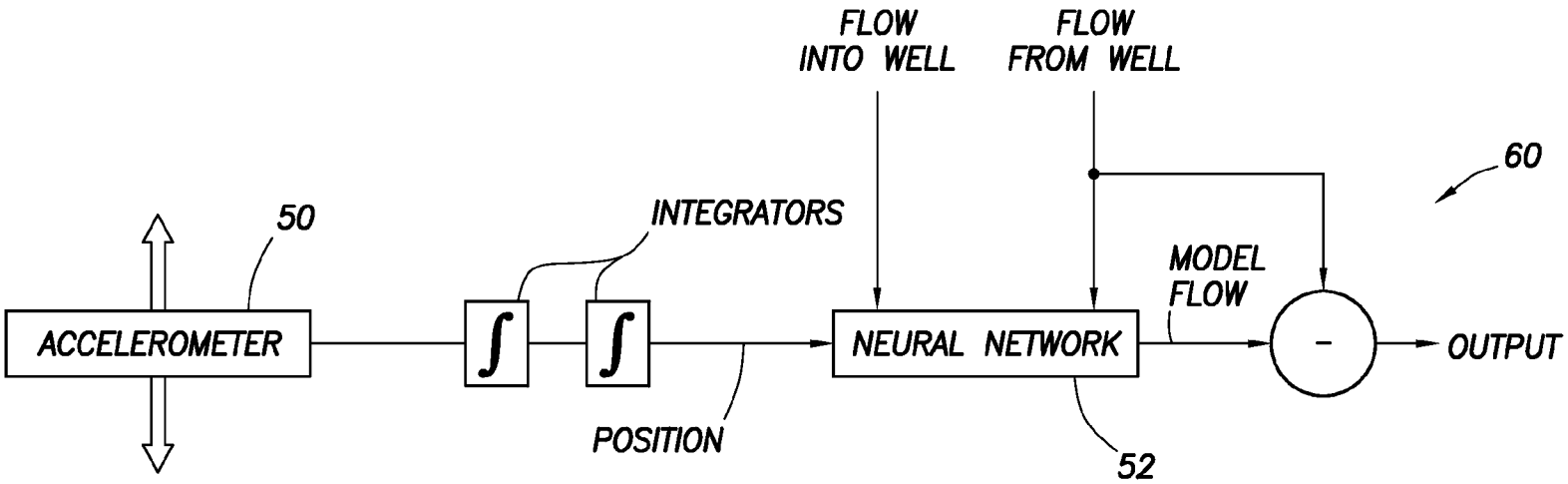

FIG. 5 depicts still another variation, where two integrators are interposed between the output of the accelerometer 50 and the input of the neural network 52. The result of double integration is that the signal input to the neural network 52 is proportional to the position of the vessel 21. The neural network 52 for the two integrator system 60 will likely be more complicated than that for the one integrator system of FIG. 4.

Alternatively, the accelerometer 50 in FIGS. 3-5 may be replaced by a geophone or other device that can output a signal proportional to velocity, or a device that outputs a signal proportional to position (e.g., a position sensor 58 of the telescoping joint 44, see FIGS. 2A & B). Of course, if the initial sensor output is changed from acceleration to velocity or position, the optimum number of integrators will change accordingly. Also, if a position sensor 58 is used, it may be most desirable to eliminate all integrators and instead interpose a differentiator between the sensor and the input to the neural network 52. Any number of differentiators could be interposed between a sensor and the neural network 52.

The systems 60 depicted in FIGS. 3-5 are made up of individual components. In actual practice, all integration, subtraction, differentiation, noise filtering and the neural network 52 itself can all be implemented in computer software. This computer software can be added to the existing software used for MPD or other closed wellbore pressure controlled drilling operations. The additional hardware, sensor and computational burden required to implement this system 60 should be very modest, and should have little to no impact on the performance of existing software systems.

The additional sensor used to implement this system 60 should be relatively small and fit comfortably inside existing equipment enclosures. Since the additional sensor can be positioned anywhere on the vessel 21, it does not have to be intrinsically safe or mounted in an explosion proof enclosure. It could simply be a small package that plugs into a computer, and be positioned out of the way in an existing facility.

It may now be fully appreciated that the above disclosure provides significant advancements to the art of detecting influxes and losses while drilling from a floating vessel. The proposed system 60 is small, simple, flexible and inexpensive, allows reliable kick and loss detection during closed wellbore pressure controlled drilling operations from a floating vessel, is self contained and preferably does not require connection to any of the vessel's motion compensation or other systems.

The additional sensor (e.g., the accelerometer 50) required for the proposed system 60 is inexpensive, small and can be permanently mounted in or on existing equipment so no additional time is required to install the system on site.

A system 60 for detecting fluid influxes into and losses from a wellbore 14 being drilled from a floating vessel 21 is described above. In one example, the system 60 can include a sensor 50, 58 which detects movement of the vessel 21, and a neural network 52 which receives an output of the sensor 50, 58, and which outputs a predicted flow rate from the wellbore 14.

The predicted flow rate is compared to an actual flow rate from the wellbore 14. A positive difference obtained by subtraction of the predicted flow rate from an actual flow rate from the wellbore 14 indicates a fluid influx. A negative difference obtained by subtraction of the predicted flow rate from an actual flow rate from the wellbore 14 indicates a fluid loss.

The system 60 can also include one or more integrators of differentiators interposed between the sensor 50, 58 and the neural network 52.

The sensor 50 comprises an accelerometer. The sensor 58 comprises a position sensor.

The system 60 can also include an annular sealing device 30 which isolates the wellbore 14 from the earth's atmosphere and seals against a drill string 16 while the neural network 52 outputs the predicted flow rate from the wellbore 14.

A method of detecting a fluid influx into or fluid loss from a wellbore 14 being drilled from a floating vessel 21 is also described above. In one example, the method can include isolating the wellbore 14 from the earth's atmosphere with an annular sealing device 30 which seals against a drill string 16; inputting to a neural network 52 an output of a sensor 50, 58 which detects movement of the floating vessel 21, the neural network 52 outputting a predicted flow rate from the wellbore 14; and determining whether the fluid influx or fluid loss has occurred by comparing the predicted flow rate from the wellbore 14 to an actual flow rate from the wellbore 14.

The inputting step can include inputting to the neural network 52 the actual flow rate from the wellbore 14. The inputting can also include inputting to the neural network 52 an actual flow rate into the wellbore 14.

Also described above is a method of detecting a fluid influx into or fluid loss from a wellbore 14 being drilled from a floating vessel 21, with the method in one example comprising: inputting to a neural network 52 an output of a sensor 50, 58 which detects movement of the floating vessel 21, an actual flow rate into the wellbore 14, and an actual flow rate out of the wellbore 14; and training the neural network 52 to output a predicted flow rate from the wellbore 14.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A system for detecting fluid influxes into and losses from a wellbore being drilled from a floating vessel, the system comprising:

a sensor which detects movement of the vessel; and a neural network which receives an output of the sensor, and which outputs a predicted flow rate from the wellbore.

2. The system of claim 1, further comprising a second sensor configured to measure an actual flow rate from the wellbore, and wherein the predicted flow rate is compared to the actual flow rate from the wellbore.

3. The system of claim 2, wherein a positive difference obtained by subtraction of the predicted flow rate from the actual flow rate from the wellbore indicates a fluid influx.

4. The system of claim 2, wherein a negative difference obtained by subtraction of the predicted flow rate from the actual flow rate from the wellbore indicates a fluid loss.

5. The system of claim 1, further comprising an integrator interposed between the sensor and the neural network.

6. The system of claim 1, further comprising multiple integrators interposed between the sensor and the neural network.

7. The system of claim 1, further comprising at least one differentiator interposed between the sensor and the neural network.

8. The system of claim 1, wherein the sensor comprises an accelerometer.

9. The system of claim 1, wherein the sensor comprises a position sensor.

10. The system of claim 1, further comprising an annular sealing device which isolates the wellbore from the earth's atmosphere and seals against a drill string while the neural network outputs the predicted flow rate from the wellbore.

11. A method of detecting a fluid influx into or fluid loss from a wellbore being drilled from a floating vessel, the method comprising:

isolating the wellbore from the earth's atmosphere with an annular sealing device which seals against a drill string;

inputting to a neural network an output of a sensor which detects movement of the floating vessel, the neural network outputting a predicted flow rate from the wellbore; and determining whether the fluid influx or fluid loss has occurred by comparing the predicted flow rate from the wellbore to an actual flow rate from the wellbore.

12. The method of claim 11, wherein the inputting further comprises inputting to the neural network the actual flow rate from the wellbore.

13. The method of claim 11, wherein the inputting further comprises inputting to the neural network an actual flow rate into the wellbore.

14. The method of claim 11, wherein the comparing further comprises a positive difference obtained by subtraction of the predicted flow rate from an actual flow rate from the wellbore indicating a fluid influx.

15. The method of claim 11, wherein the comparing further comprises a negative difference obtained by subtraction of the predicted flow rate from an actual flow rate from the wellbore indicating a fluid loss.

16. The method of claim 11, further comprising interposing an integrator between the sensor and the neural network.

17. The method of claim 11, further comprising interposing multiple integrators between the sensor and the neural network.

18. The method of claim 11, further comprising interposing at least one differentiator between the sensor and the neural network.

19. The method of claim 11, wherein the sensor comprises an accelerometer.

20. The method of claim 11, wherein the sensor comprises a position sensor.

21. A method of detecting a fluid influx into or fluid loss from a wellbore being drilled from a floating vessel, the method comprising:

inputting to a neural network an actual flow rate into the wellbore, an actual flow rate out of the wellbore, and an output of a sensor which detects movement of the floating vessel; and training the neural network to output a predicted flow rate from the wellbore.

22. The method of claim 21, further comprising determining whether the fluid influx or fluid loss has occurred by comparing the predicted flow rate from the wellbore to the actual flow rate from the wellbore.

23. The method of claim 22, wherein the comparing further comprises a positive difference obtained by subtraction of the predicted flow rate from an actual flow rate from the wellbore indicating a fluid influx.

24. The method of claim 22, wherein the comparing further comprises a negative difference obtained by subtraction of the predicted flow rate from an actual flow rate from the wellbore indicating a fluid loss.

25. The method of claim 21, further comprising interposing an integrator between the sensor and the neural network.

26. The method of claim 21, further comprising interposing multiple integrators between the sensor and the neural network.

27. The method of claim 21, further comprising interposing at least one differentiator between the sensor and the neural network.

28. The method of claim 21, wherein the sensor comprises an accelerometer.

29. The method of claim 21, wherein the sensor comprises a position sensor.

30. The method of claim 21, further comprising isolating the wellbore from the earth's atmosphere with an annular sealing device which seals against a drill string.

* * * * *